US008314538B2

(12) United States Patent
Hombach et al.

(10) Patent No.: US 8,314,538 B2
(45) Date of Patent: Nov. 20, 2012

(54) DIELECTRIC BARRIER DISCHARGE LAMP WITH A RETAINING DISC

(75) Inventors: Axel Hombach, Kürten (DE); Oliver Rosier, Wipperfürth (DE)

(73) Assignee: Osram AG, Munich (DE)

( * ) Notice: Subject to any disclaimer, the term of this patent is extended or adjusted under 35 U.S.C. 154(b) by 67 days.

(21) Appl. No.: 12/918,979

(22) PCT Filed: Feb. 21, 2008

(86) PCT No.: PCT/EP2008/052100

§ 371 (c)(1),
(2), (4) Date: Aug. 23, 2010

(87) PCT Pub. No.: WO2009/103337

PCT Pub. Date: Aug. 27, 2009

(65) Prior Publication Data

US 2011/0001426 A1 Jan. 6, 2011

(51) Int. Cl.
*H01J 1/18* (2006.01)

(52) U.S. Cl. ..... 313/238; 313/283; 313/285; 313/288; 313/292

(58) Field of Classification Search ..... 313/238, 313/243, 250, 267, 281, 283–285, 288, 292, 313/574, 607, 610, 620
See application file for complete search history.

(56) References Cited

U.S. PATENT DOCUMENTS

| | | | | |
|---|---|---|---|---|
| 4,945,290 | A | 7/1990 | Eliasson et al. | |
| 6,084,337 | A * | 7/2000 | Beardmore | 313/292 |
| 2005/0035700 | A1 * | 2/2005 | Yano et al. | 313/234 |

FOREIGN PATENT DOCUMENTS

| | | |
|---|---|---|
| DE | 199 53 533 | 5/2001 |
| DE | 102 13 327 | 6/2003 |
| EP | 0 363 832 | 4/1990 |
| EP | 1 147 535 | 10/2001 |
| WO | WO 01/35436 | 5/2001 |

* cited by examiner

*Primary Examiner* — Bumsuk Won
(74) *Attorney, Agent, or Firm* — Cozen O'Connor

(57) ABSTRACT

A dielectric barrier discharge lamp (1) with a discharge vessel, which has an outer tube (2), which surrounds a discharge space (4) filled with a discharge medium, an outer electrode (6), which is arranged on the outer side of the outer tube (2), an elongate inner electrode (7), which is arranged axially within the outer tube (2), at least one retaining disk (8) with an axial bore, through which the elongate inner electrode (7) runs, the retaining disk (8) extending substantially from the inner electrode (7) up to the inner side of the outer tube (2), as a result of which the inner electrode (7) is centered at least indirectly within the discharge vessel. The retaining disk (8) is supported on both sides loosely in the direction of the longitudinal axis by means of a supporting means (9*a*-9*c*) on the left-hand side and a supporting means (10*a*-10*c*) on the right-hand side.

18 Claims, 3 Drawing Sheets

A-A

DIELECTRIC BARRIER DISCHARGE LAMP WITH A RETAINING DISC

RELATED APPLICATIONS

This is a U.S. national stage of application No. PCT/EP2008/052100, filed on Feb. 21, 2008, the entire content of which is hereby incorporated by reference.

TECHNICAL FIELD

1. Field of the Invention

The invention is related to a dielectric barrier discharge lamp with a tubular discharge vessel surrounding a discharge medium.

2. Background of the Invention

This type of discharge lamp typically has a first elongate electrode, which is arranged within the tubular discharge vessel, also referred to below as inner electrode, and a second elongate electrode, which is generally arranged on the outer side of the tubular discharge vessel, also referred to below as the outer electrode.

If the inner electrode is in direct contact with the discharge medium, there is a discharge which is dielectrically impeded on one side since in this case only the outer electrode is dielectrically impeded by the wall of the discharge vessel. If the inner electrode is likewise separated from the discharge medium by a dielectric, there is a discharge which is dielectrically impeded on two sides. This can be implemented, for example, by virtue of the fact that the inner electrode is arranged within an inner tube. The inner tube is arranged coaxially within the tubular discharge vessel. In other words, the discharge vessel, in this so-called coaxial double-tube arrangement, has an inner tube arranged coaxially within an outer tube, the two tubes being connected to one another at both of their end sides and thus forming the gas-tight discharge vessel. The discharge space surrounded by the discharge vessel therefore in this case extends between the inner tube and the outer tube.

In any case, a constant arcing distance between the outer electrode and the inner electrode along the tubular dielectric barrier discharge lamp needs to be ensured for efficient lamp operation in order to achieve a uniform discharge and therefore radiation density, when viewed along the lamp longitudinal axis and the lamp circumference. Therefore, the inner electrode and possibly the inner tube needs to be arranged as centrally as possible within the outer tube. In particular in the case of long lamps, there is the additional problem of sag for the inner electrode or possibly the inner tube since the latter naturally has a smaller diameter than the outer tube. In an extreme case, this can result in damage to the lamp, for example during transport.

This type of lamp can be used in particular for UV radiation in processing technology, for example for surface cleaning and activation, photolitics, ozone generation, drinking water purification, metal-plating and UV curing. In this context, the term emitter or UV emitter is also conventional.

The document EP 1 147 535 B1 has disclosed a discharge lamp with a dielectric barrier on one side. In this case, a first coiled inner electrode 6 is wound onto an inner tube 9 (see FIG. 1 in said document). The inner tube 9 is arranged coaxially within an outer tube 3, on the outer side of which strip-shaped outer electrodes 7 are arranged parallel to one another and at a mutual distance. In order to support the inner tube 9, said document proposes, for example, a retaining disk 15, which is pushed over the inner electrode 6. There is no disclosure relating to fastening of the retaining disk 15 to the inner side of the outer tube 3, which fastening is required per se.

SUMMARY OF THE INVENTION

One object of the present invention is to provide a tubular dielectric barrier discharge lamp with an improved retaining arrangement for the inner electrode or possibly the inner tube surrounding the inner electrode.

This object is achieved by one aspect of the invention directed to a dielectric barrier discharge lamp with a discharge vessel, which has an outer tube, which surrounds a discharge space filled with a discharge medium, an outer electrode, which is arranged on the outer side of the outer tube, an elongate inner electrode, which is arranged axially within the outer tube, at least one retaining disk with an axial bore, through which the elongate inner electrode runs, the retaining disk extending substantially from the inner electrode up to the inner side of the outer tube, as a result of which the inner electrode is centered at least indirectly within the discharge vessel, characterized in that the retaining disk is supported on both sides loosely in the direction of the longitudinal axis by means of a supporting means on the left-hand side and a supporting means on the right-hand side.

A feature of the invention involves not connecting the retaining disk for centering the inner electrode or possibly the inner tube fixedly to the discharge vessel, but merely supporting said retaining disk loosely on both sides in order thereby to reliably prevent the retaining disk from sliding along the lamp longitudinal axis.

That is to say that the inventors have found that a rigid connection between the retaining disk and the discharge vessel has some disadvantages. For example, it has been shown that stresses and/or cracks in the retaining disk which arise either as early as during manufacture of the retaining disk or in the course of lamp operation by means of solarization extend onto the discharge vessel and can result in mechanical destruction thereof. In addition, the discharge vessel is deformed when welded directly to the retaining disk. The material of the discharge vessel, which is generally made from quartz glass owing to the good transparency which is required for electromagnetic radiation in the ultraviolet range, is weakened at the joint. In the event of mechanical loading, for example as a result of impacts during transport or as a result of oscillations during operation of the discharge lamp, this local weakening of the quartz glass acts as a desired breaking point, which can ultimately result in breakage of the discharge vessel. The attempt to spot-weld the retaining disk on the outer tube or, if provided, on the inner tube of the discharge vessel has not produced any satisfactory results either. Although spot-welding makes it possible to keep damage to the discharge vessel within acceptable limits, the welded joints become detached during loading, with the result that permanent fastening of the retaining disk by virtue of spot-welding is not ensured.

According to an embodiment of the invention, two supporting means are provided per retaining disk, said supporting means only supporting the retaining disk loosely on both sides in order to prevent said retaining disk from sliding axially.

In the simplest case, one supporting means merely comprises a material bead, which has been applied to the inner tube or possibly also only to an inner tube piece, for example. In this case, the retaining disk is only arranged between two material beads. It may also be advantageous to provide more than one material bead per side, in particular for said material beads to be arranged uniformly distributed over the circumference. It is critical that the respective distance A between the material bead on the left-hand side and the corresponding material bead on the right-hand side is greater than the thickness D of the retaining disk in order for the retaining disk to be mounted loosely. It would at least be necessary for the margin A-D to be greater than the thermal expansion of the materials in order for the initially loose retaining disk not to become stuck by being heated during manufacture or during lamp operation and then nevertheless for the undesired stresses to arise. In this context, it has proven to be advantageous if the relationship between the mutual distance A between the two supporting means and the thickness D of the retaining disk is as follows:

$$A = D + \frac{D}{x}, \tag{1}$$

where $0.1<x<1000$, in particular $1<x<250$. This ensures that, firstly, the retaining disk remains loose with respect to the supporting means and it is therefore not possible for any stresses to be transferred from the retaining disk. Secondly, it is still possible in terms of manufacturing technology to arrange the material beads correspondingly. Taking into consideration the conventional manufacturing tolerances, a margin A−D of typically approximately 1 mm has proven to be practicable, for example. The thickness D of the retaining disk should firstly be as small as possible in order to disrupt the electrical and optical properties of the lamp as little as possible. Secondly, the retaining disk needs to be sufficiently mechanically stable. It is known from experience that a thickness D of approximately 1 to a few millimeters, for example 2 mm, is sufficient for a corresponding retaining disk made from quartz glass.

In principle, the supporting means according to an embodiment of the invention can be fastened both to the inner side of the outer tube and to the outer side of the inner tube, if provided. However, the latter case is preferred since it is simpler in terms of manufacturing technology to apply the supporting means to the outer side of the inner tube since the inner side of the outer tube is less easily accessible, especially in the central region of the tube. In this case, first a material bead is applied to the outer side of the inner tube or a plurality of material beads are distributed in the form of a circle over the circumference of the inner tube. Then, the retaining disk is plugged on and finally, after the disk, again one or more material beads are applied to the outer side of the inner tube, to be precise at a suitable distance from the material beads on the other side. This ensures that the retaining disk is supported by the material beads only so as to prevent said retaining disk from sliding, but virtually without any stresses being transferred thereby.

Preferably, once the retaining disk has been plugged on, a supporting ring is also plugged on and only then is/are the terminating material bead(s) applied. The supporting ring has the advantage that the retaining disk has a greater distance from the point at which heat is introduced when the material bead(s) is/are applied, for example when a quartz bead is welded to a quartz tube, and is therefore subjected to less thermal loading. To this extent, no supporting ring is required on the other side of the retaining disk as long as the retaining disk is only plugged on once the material bead(s) has/have been welded. In a time-saving manufacturing variant, the material beads are welded to both sides of the retaining disk simultaneously. In this case, in each case one supporting ring is provided preferably for both sides of the retaining disk.

In general, a supporting ring can either be mounted loosely on the inner tube and merely prevented from sliding away from the retaining disk in the direction of the longitudinal axis by at least one material bead or the relatively loose supporting ring can under certain circumstances hit against the at least one material bead and damage said material bead mechanically. In order to be able to eliminate this possible problem from the outset, the supporting ring can alternatively also be spot-welded directly to the inner tube. To this extent, the term material bead should be understood in general terms such that it also includes the welded joints characteristic of spot-welding. In the latter case, the supporting ring is therefore fixedly connected to the tube via at least one material bead.

A further advantage of the supporting ring is in any case the uniform distribution of force onto the fastening or fixing in the event of movement of the retaining disk. That is to say that, by virtue of the supporting ring, the mechanical loading on the individual material bead(s) is reduced.

The supporting ring can also have a slot or comprise two or more segments. If appropriate, each segment of the supporting ring is spot-welded individually, i.e. connected to a material bead applied to the tube.

In order to keep the flow resistance as low as possible during evacuation and subsequent filling of the discharge space of the dielectric barrier discharge lamp, the retaining disk is preferably provided with one or more openings, for example bores or cutouts.

The retaining ring and the supporting ring are manufactured from an electrically insulating material, preferably from an insulating material which is largely resistant to ultraviolet radiation, for example quartz glass, ceramic or the like.

The supporting ring preferably has a thickness S in the range of between approximately 0.5 mm and 3 mm. The width B of the supporting ring is preferably in the range of between approximately 2 mm and 6 mm.

BRIEF DESCRIPTION OF THE DRAWINGS

The invention will be explained in more detail below with reference to exemplary embodiments. In the figures.

DETAILED DESCRIPTION OF THE DRAWINGS

Identical or functionally identical elements have been provided with the same reference symbols in the figures.

Figure 1A:
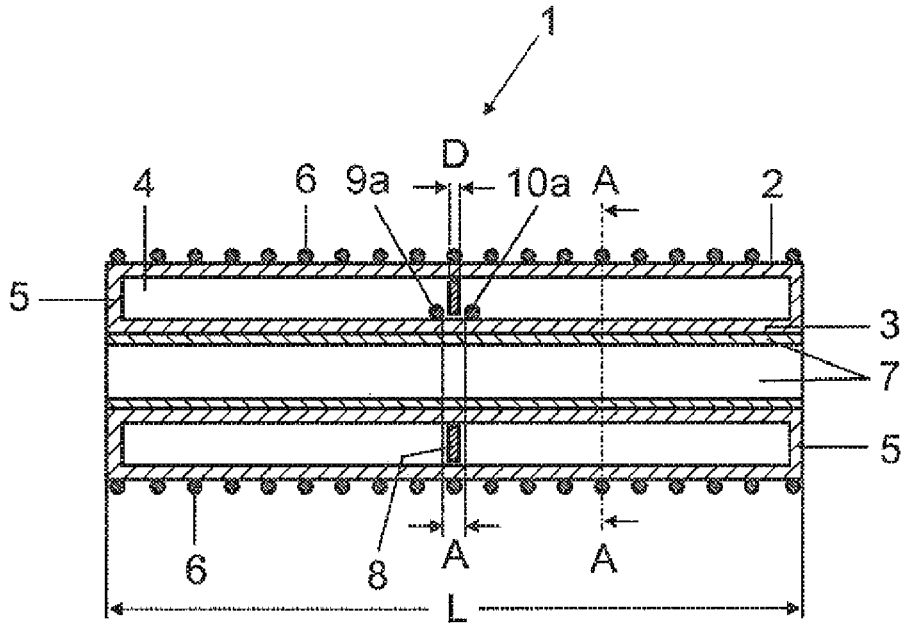
FIG. 1*a* shows an illustration of a longitudinal section through a dielectric barrier discharge lamp according to an embodiment of the invention.
Figure 1B:
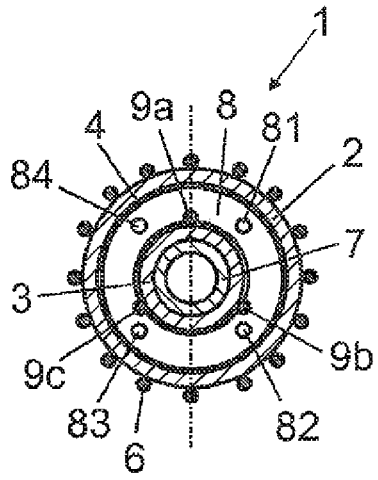
FIG. 1*b* shows a cross-sectional illustration of the lamp shown in FIG. 1*a*.

FIGS. 1*a* and 1*b* show a very schematized illustration of a longitudinal section and, respectively, a cross section of a first exemplary embodiment of the dielectric barrier discharge lamp 1 according to the invention. The elongate discharge vessel of the lamp 1 comprises an outer tube 2 and an inner tube 3 in a coaxial double-tube arrangement, said inner and outer tubes thus defining the longitudinal axis of the discharge vessel. The typical length L of the tubes is between approximately 10 and 250 cm, depending on the application. The outer tube 2 has a diameter of 44 mm and a wall thickness of 2 mm. The inner tube 3 has a diameter of 20 mm and a wall thickness of 1 mm. The radial extent of the discharge between the inner electrode and the outer electrode is therefore approximately 10 mm ([44 mm−2 times 2 mm−20 mm]/2). The two tubes 2, 3 are made from quartz glass which is permeable to UV radiation. In addition, the discharge vessel is sealed at both of its end sides in such a way that an elongate discharge space 4 in the form of an annular gap is formed. For this purpose, the discharge vessel has in each case suitably shaped, annular vessel sections 5 at its two ends. In addition, an exhaust tube (not illustrated) is attached to one of the vessel sections 5 and is used initially to evacuate the discharge space 4 and then to fill said discharge space 4 with 15 kPa of xenon. A wire mesh 6 is drawn onto the outer side of the wall of the outer tube 2 and forms the outer electrode of the lamp 1. A metallic flexible fabric tube 7 made from stainless steel is arranged in the interior of the inner tube 3 and acts as the inner electrode. A retaining disk 8 made from quartz glass with a thickness D of 2 mm is arranged loosely approximately in the center of the discharge vessel. The retaining disk 8 has a central bore such that it can be pushed easily onto the inner tube 3. In addition, the retaining disk 8 is provided with four bores 81-84 in order to keep the flow resistance as low as possible during evacuation and subsequent filling of the discharge space 4. In each case three quartz glass beads 9*a*-9*c*, 10*a*-10*c* are attached to the surface of the inner tube 3 on the left and right of the retaining disk 8. The quartz glass beads are distributed uniformly in the form of a circle over the circumference of the inner tube on each side, i.e. are arranged at an angular distance of 120° (see FIG. 1*b*). The distance A between the three quartz glass beads 9*a*-9*c* on one side and the quartz glass beads 10*a*-10*c* on the other side is approximately 3 mm, with the result that a margin of approximately A−D=1 mm still remains for the retaining disk 8 arranged therebetween. Corresponding to the relationship (1), a value of 2 follows from this for the parameter x (x=D/[A−D]). The diameter of the retaining disk 8 is approximately 1 mm smaller than the inner diameter of the outer tube 2, with the result that there is still some margin and the outer tube 10 can be pushed over the inner tube 3 with the retaining disk 8 without any problems.

Figure 2A:
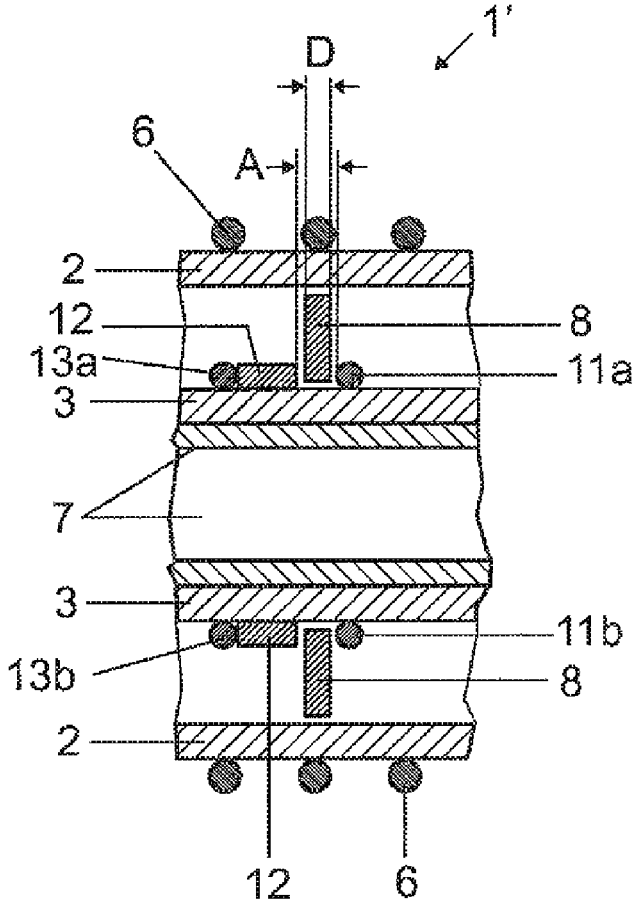
FIG. 2*a* shows an enlarged detail of a variant of the lamp shown in FIG. 1*a*.
Figure 2B:
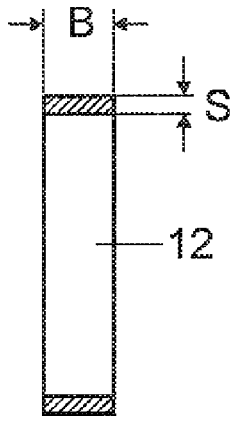
FIG. 2*b* shows an illustration of a longitudinal section through the supporting ring in FIG. 2*a*.

FIG. 2*a* illustrates a partial view of one variant. Said figure only shows the central region of the lamp 1' with the retaining disk 8 and the supporting means on both sides. As in the first exemplary embodiment, three quartz glass beads 11*a*-11*c* are applied to the inner tube 3 to the right of the retaining disk 8. The supporting means additionally comprises a supporting ring 12, which has been pushed onto the inner tube 3 and has been fastened to the inner tube 3 with two quartz glass beads 13*a*, 13*b*, on the left of the retaining disk 8. The supporting ring 12 has a thickness S of approximately 2 mm and a width B of approximately 5 mm (see also in this regard FIG. 2*b*). The supporting ring 12 has the advantage that the zone in which heat is introduced is removed from the retaining disk 8 by a distance which approximately corresponds to the width B of the supporting ring 12 when that edge of the supporting ring 12 which is remote from the retaining disk 8 is joined to the two quartz glass beads 13*a*, 13*b*. This assists the supporting ring 12 in reducing the thermal loading or the thin retaining disk 8. The distance A between the three quartz glass beads 11*a*-11*c* on the right-hand side and the supporting ring 12 on the left-hand side is approximately 3 mm, with the result that a margin of approximately A−D=1 mm still remains for the retaining disk 8 arranged therebetween.

Figure 3:
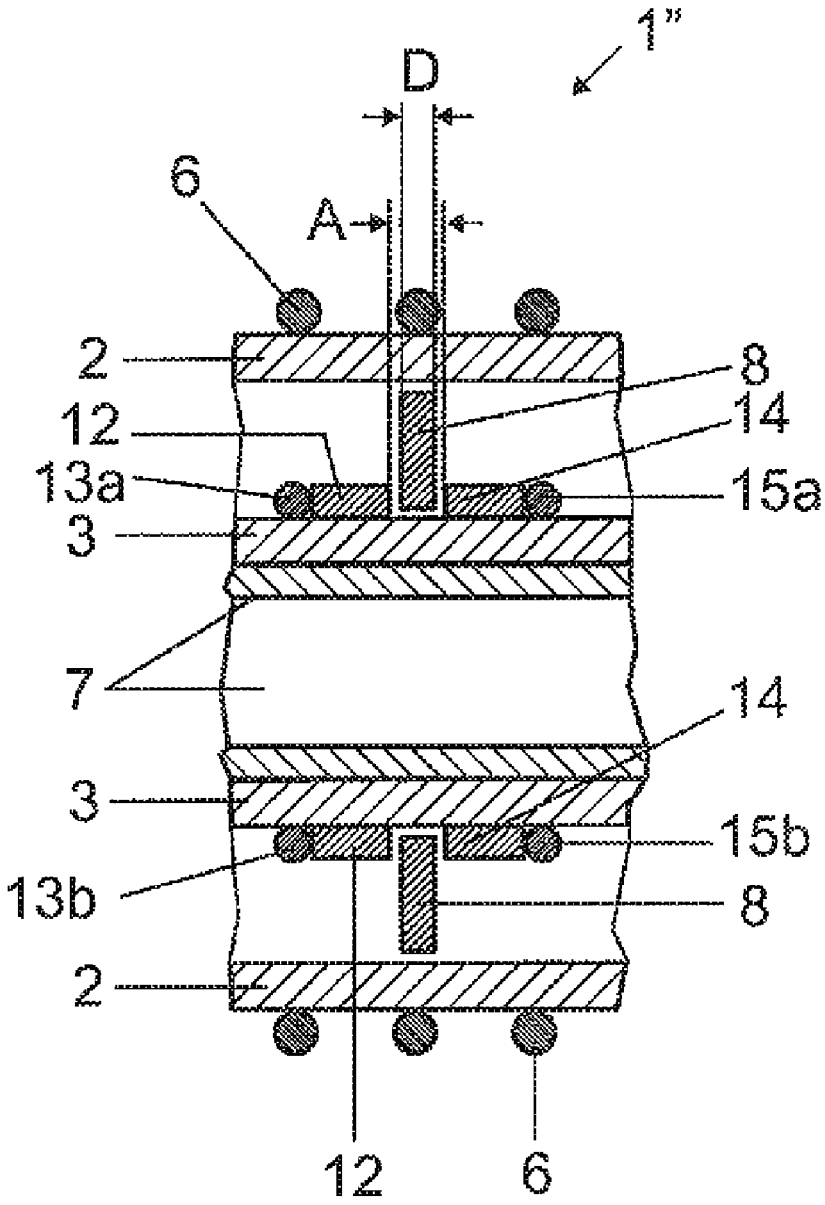
FIG. 3 shows an enlarged detail of a further variant of the lamp shown in FIG. 1*a*.

The variant of the lamp 1" illustrated in FIG. 3 differs from the previous variant merely in that the supporting means now in each case comprise a supporting ring 12, 14 on both sides of the retaining disk 8. The right-hand supporting ring 14 is in this case fastened to the inner tube 3 with two quartz glass beads 15*a*, 15*b*, in the same way as the left-hand supporting ring 12 is in the previous variant. The mutual distance between the two supporting rings 12, 14 is approximately 3 mm, with the result that, in this variant too, a margin of approximately 1 mm remains for the retaining disk 8.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A dielectric barrier discharge lamp comprising:

a discharge vessel, which has an outer tube, which surrounds a discharge space filled with a discharge medium;

an outer electrode, which is arranged on the outer side of the outer tube;

an elongate inner electrode, which is arranged axially within the outer tube;

at least one retaining disk with an axial bore, through which the elongate inner electrode runs, the retaining disk extending substantially from the inner electrode up to the inner side of the outer tube, as a result of which the inner electrode is centered at least indirectly within the discharge vessel;

wherein the retaining disk is supported on both sides loosely in the direction of the longitudinal axis by a first supporting means on the left-hand side and a second supporting means on the right-hand side, and wherein the inner electrode is surrounded, at least in the region of the retaining disk, by an inner tube, against which the retaining disk is supported.

2. The lamp as claimed in claim 1, the inner tube extending within the discharge vessel along the entire lamp length, and the inner tube and the outer tube being connected to one another in a gas-tight manner in the form of a coaxial double-tube arrangement.

3. The lamp as claimed in claim 1, the two supporting means being fastened on the outer side of the inner tube.

4. The lamp as claimed in claim 1, said first and second supporting means being fastened on the inner side of the outer tube.

5. The lamp as claimed in claim 1, said first and second supporting means having a distance A from one another which is greater than the thickness D of the retaining disk.

6. The lamp as claimed in claim 5, the relationship between the mutual distance A between the two supporting means and the thickness D of the retaining disk being as follows:

$$A = D + \frac{D}{x}, \text{ where } 0.1 < X < 1000.$$

7. The lamp as claimed in claim 1, said first and second supporting means each comprising at least one material bead, which material beads are connected to the tube.

8. The lamp as claimed in claim 7, at least one of said first and second supporting means on one side of the retaining disk comprising a supporting ring, which is arranged between the retaining disk and the corresponding at least one material bead.

9. The lamp as claimed in claim 8, the supporting ring having a slot.

10. The lamp as claimed in claim 8, the supporting ring having two or more segments, and each segment being connected to a material bead.

11. The lamp as claimed in claim 8, the supporting ring having a thickness in the range of between approximately 0.5 mm and 3 mm.

12. The lamp as claimed in claim 8, the width of the supporting ring being in the range of between approximately 2 mm and 6 mm.

13. The lamp as claimed in claim 1, the retaining disk being provided with one or more openings, in addition to the axial bore.

14. A dielectric barrier discharge lamp comprising:

a discharge vessel, which has an outer tube, which surrounds a discharge space filled with a discharge medium;

an outer electrode, which is arranged on the outer side of the outer tube;

an elongate inner electrode, which is arranged axially within the outer tube;

at least one retaining disk with an axial bore, through which the elongate inner electrode runs, the retaining disk extending substantially from the inner electrode up to the inner side of the outer tube, as a result of which the inner electrode is centered at least indirectly within the discharge vessel;

wherein the retaining disk is supported on both sides loosely in the direction of the longitudinal axis by a first supporting means on the left-hand side and a second supporting means on the right-hand side, wherein said first and second supporting means each comprise at least one material bead, which material beads are connected to the tube, and wherein at least one of said first and second supporting means on one side of the retaining disk comprise a supporting ring, which is arranged between the retaining disk and the corresponding at least one material bead.

15. The lamp as claimed in claim 14, the supporting ring having a slot.

16. The lamp as claimed in claim 14, the supporting ring having two or more segments, and each segment being connected to a material bead.

17. The lamp as claimed in claim 14, the supporting ring having a thickness in the range of between approximately 0.5 mm and 3 mm.

18. The lamp as claimed in claim 14, the width of the supporting ring being in the range of between approximately 2 mm and 6 mm.

* * * * *